US006437302B1

(12) United States Patent
Bowers

(10) Patent No.: US 6,437,302 B1
(45) Date of Patent: Aug. 20, 2002

(54) INTERRUPTIBLE VARIABLE FREQUENCY POWER SUPPLY AND LOAD MATCHING CIRCUIT, AND METHOD OF DESIGN

(75) Inventor: Thomas J. Bowers, New Berlin, WI (US)

(73) Assignee: Pillar Industries, Brookfield, WI (US)

( * ) Notice: Subject to any disclaimer, the term of this patent is extended or adjusted under 35 U.S.C. 154(b) by 0 days.

(21) Appl. No.: 09/652,256

(22) Filed: Aug. 24, 2000

(51) Int. Cl.[7] ..... H05B 6/06

(52) U.S. Cl. ..... 219/661; 219/665; 219/663; 323/328; 363/50; 363/165

(58) Field of Search ..... 219/661, 660, 219/665, 666, 663, 668; 363/39, 40, 49, 50, 74, 95, 97, 165; 323/328, 340, 341

(56) References Cited

U.S. PATENT DOCUMENTS 3,781,505 A * 12/1973 Steigerwald ..... 219/665
3,786,219 A * 1/1974 Kornrumpf et al. ..... 219/665
4,423,461 A * 12/1983 Kaainoa et al. ..... 363/37
4,604,530 A * 8/1986 Shibuya ..... 307/66
5,319,174 A 6/1994 Omori et al. ..... 219/664
5,902,506 A * 5/1999 Scott et al. ..... 219/666

FOREIGN PATENT DOCUMENTS

GB 2 083 302 * 3/1982

* cited by examiner

*Primary Examiner*—Philip H. Leung
(74) *Attorney, Agent, or Firm*—Timothy J. Ziolkowski; J. Mark Wilkinson

(57) ABSTRACT

A load matching circuit is disclosed for use with a frequency controlled power supply. The load matching circuit includes an input connectable to the frequency controlled power supply and an output connectable to the load, such as an induction heating coil. A load matching section is connected between the input and the output to provide enough resonance to allow the power supply to operate at or below the maximum frequency when the load is connected to the power supply and at or above the minimum frequency when the load is disconnected from the power supply. In this manner, a solid-state variable frequency power supply can continue to run even when the external load is disconnected from the power supply.

25 Claims, 1 Drawing Sheet

INTERRUPTIBLE VARIABLE FREQUENCY POWER SUPPLY AND LOAD MATCHING CIRCUIT, AND METHOD OF DESIGN

BACKGROUND OF THE INVENTION

The present invention relates generally to variable frequency power supplies, and more particularly to, the use of a variable frequency power supply in an induction heater where the load is interruptible from the power supply.

Variable frequency power supplies are designed to operate at or near the resonance of the load that the power supply is connected to. Solid-state inverters, by their nature, have an inherent maximum and minimum operating frequency. Most such solid-state inverters cannot run without a resonant load and an output current to that load. Such inverters will automatically shut down if the current falls below a minimum current and/or the load resonant frequency falls below a minimum value or exceeds a maximum value. This is especially problematic in induction heaters since if the power supply shuts down during a heating process, the process will likely be ruined and the part being heated will likely need to be discarded. Further, much time is lost in restarting the power supply and the heating process.

In most induction heating applications, an inverter operating frequency is adequately controlled with voltage and current phase feedback to a control that provides frequency control signals to the inverter. In most of these induction heaters, the inductive heating coil is positively, or permanently, connected to the power supply such that only a defect or major breakdown will cause an interruption thereby shutting down the power supply. However, in some applications, the connection between the load and the power supply is not direct. In these applications, the load may move with respect to the power supply and the electrical connection between the load and the power supply is by a friction connector. Such friction connectors are known to arc and allow intermittent interruption, thereby changing the resonance frequency of the circuit and/or even allowing the inductance to go to infinity, resulting in the frequency being reduced below the minimum frequency of the inverter thereby shutting down the power supply. Solid State inverters are especially susceptible to shut down if the resonance frequency falls below the minimum frequency for even an instant. Therefore, solid-state inverters have generally not been used with friction connectors or with any intermittently interruptible load.

It would be desirable to be able to use a solid-state inverter power supply with a load that is prone to intermittent disconnection, or arcing, but does not shut down in response thereto.

SUMMARY OF THE INVENTION

The present invention solves the aforementioned problems by providing an interruptible frequency control power supply and a matching circuit that allows the power supply to continue to run even when the load is disconnected from the power supply.

The present invention provides an internal load in conjunction with the power supply that is sized just large enough to maintain a run state of the power supply as determined by the low frequency limit. This internal load is connected to the power supply such that when both the internal load and the external load are connected, the power supply can run at the high end of its frequency spectrum. If the external load drops out, or is disconnected, the power supply is able to continue to run at the low end of its frequency spectrum. This provides a frequency controlled power supply that is operable with infinite inductance, or zero resonance, at the load.

In accordance with one aspect of the invention, a resonant load matching circuit is disclosed that includes a circuit input connectable to a variable frequency inverting power supply to receive power operable between a maximum frequency and a minimum frequency. The matching circuit also includes a circuit output connectable to an inductive load. The load matching section is connected between the circuit input and the circuit output to provide a resonant frequency that allows the power supply to operate at or below the maximum frequency when the load is connected to the circuit output and at or above the minimum frequency when the load is disconnected from the circuit output.

In accordance with another aspect of the invention, a load interruptible variable frequency power supply is disclosed having an inverter and phase detector to supply power to an inductive load at a resonant frequency. The inverter has a minimum and a maximum operating frequency. A feedback circuit is connected to the phase detector to adjust a phase relationship between the voltage phase and the current phase based on the resonant frequency. A matching section is connected between the inverter and the inductive load. This matching section has an effect on the resonant frequency such that when the inverter is connected to the matching section and the load, the resonant frequency is at or below the maximum operating frequency. When the inverter is connected to the matching section and disconnected from the load, the resonant frequency is at or above the minimum operating frequency.

In accordance with another aspect of the invention, a method of providing power from a solid-state inverter to a load that is susceptible to disconnection from the solid-state inverter without shutting down the solid-state inverter during disconnection includes determining a minimum and maximum operating frequency of the solid-state inverter and determining an inductance of a load connectable to the solid-state inverter and a resulting operating resonance. The method also includes selecting an LC matching section connectable between the solid-state inverter and the load that permits the solid-state inverter to run at or under its maximum operating frequency when the load is connected to the solid-state inverter and to run at or above its minimum operating frequency when the load is at least partially disconnected from the solid-state inverter.

Various other features, objects and advantages of the present invention will be made apparent from the following detailed description and the drawings.

BRIEF DESCRIPTION OF THE DRAWINGS

The drawings illustrate a preferred embodiment as presently contemplated for carrying out the invention.

In the drawings.

DETAILED DESCRIPTION OF THE PREFERRED EMBODIMENT

Figure 1:
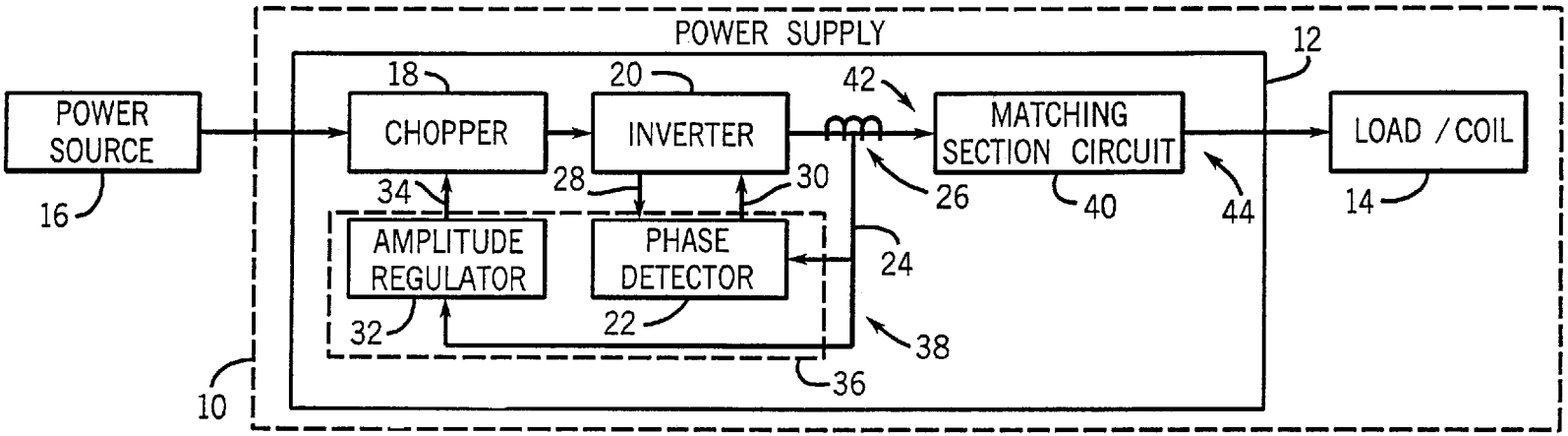
FIG. 1 is a block diagram of an induction heating apparatus connected to a power source incorporating the present invention.

FIG. 1 shows an induction heating apparatus 10 that, in general, includes a power supply 12 connected to a load or induction heating coil 14. The induction heating apparatus is connected to and receives power from an external power source 16. In one preferred embodiment, the power supply 12 includes a chopper circuit 18 connected to an inverter 20. The chopper circuit controls and regulates a DC voltage level to the inverter 20. The inverter 20 is a variable frequency inverter and operates at a resonant frequency dictated by the overall circuit in the induction heating apparatus 10. That is, the operating resonant frequency depends on the internal capacitance and inductance of the power supply 12 and the capacitance and inductance of the load 14. It is known that such inverters have a minimum and a maximum operating frequency. Typically, the operating frequency of the induction heating apparatus 10 is chosen based on the load to operate near the maximum frequency for most efficient operation. However, changing characteristics of the load caused by temperature, age, and the use of the load, can change the resonant frequency of the circuit on-the-fly. Also, the power source 16 can somewhat vary the lead/lag of the voltage and current, thereby changing the resonance of the circuit.

Therefore, a phase detector 22 is connected to receive a current phase signal 24 from a current sensor, such as a current transformer 26. The phase detector 22 senses the current phase signal 24 and a voltage phase signal 28 from the inverter 20 and provides a frequency control signal 30 to change the operating frequency of the inverter 20 on-the-fly. The current phase signal 24 is also supplied to an amplitude regulator 32 which provides feedback 34 to the chopper 18 for regulating the amplitude of the signal to the inverter 20. The phase detector 22 and the amplitude regulator 32 form a control 36 of the power supply 12.

Generally, a feedback circuit 38 includes the current phase signal 24 and the voltage phase signal 28 connected to the control 36 to adjust a phase relationship between the phase of the voltage and the phase of the current based on the resonant frequency of the circuit. As is known, the control circuit 36 receives the current phase and voltage phase inputs and in response, locks onto a resonant frequency to drive the voltage and current in phase. That is, if the current is leading, then the circuit is operating at above resonance and must be reduced, and if the voltage is leading, the circuit is operating below resonance and must be increased. The control circuit 36 provides feedback through the frequency control signal 30 to the inverter 20 to lock into the new resonance frequency without shutting down the power supply 12.

A resonant load matching circuit 40 includes a circuit input 42 connectable to a variable frequency inverting power supply, as previously discussed, to receive power operable between a maximum frequency and a minimum frequency. The matching section circuit 40 includes a circuit output 44 connectable to the inductive load 14 which has a characteristic operating resonant frequency when connected and in operation. The matching section 40 is preferably connected between the inverter 20 and the resonant load 14. The matching section 40 is designed to have an effect on the resonant frequency such that when the inverter 20 is connected to the matching section 40 and the load 14, the resonant frequency is at or below the maximum operating frequency. Also, the matching section 40 is designed such that when the inverter 20 is connected to the matching section 16, but disconnected from the load 14, the power supply 12 will continue to run at a resonant frequency at or above the minimum operating frequency of the inverter 20. In this manner, power supply 12 need not shut down when the load 14 is disconnected from the power supply.

Figure 2:
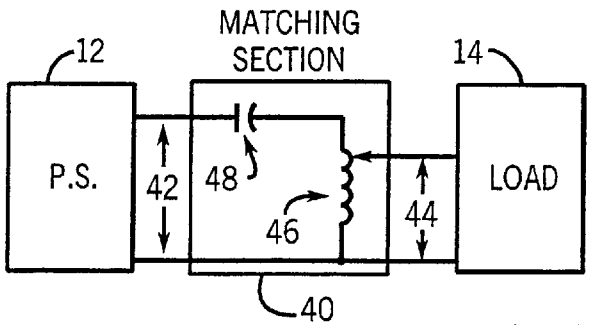
FIG. 2 is a block diagram showing an embodiment of a matching section circuit in accordance with the present invention.

Referring to FIG. 2, one embodiment of the matching section 40 is shown connected to the power supply 12 and the load 14. In this embodiment, the matching section 40 includes an internal inductor 46 and a capacitor 48. Generally, the inductance of the inductor 46 is chosen approximately twice, or more, that of the load 14. One skilled in the art will readily recognize that choosing a value of the inductor 46 depends greatly on design choices and the load 14. Once the general starting point is achieved, the design parameters can be verified with either a commercially available simulation package or by trial and error. If trial and error is the method of choice, preferably inductor 46 is an adjustable tapped inductor so that the power supply 12 can be matched to the load 14 at a customer site. The LC value of the inductor 46 and the capacitor 48 is chosen such that the resonance of the matching section 40 is at least equal to the minimum frequency of the power supply so that the power supply 12 maintains continuous operation with or without the load 14 connected to the power supply 12.

The inductor 46 of the matching section 40 is connected in series with the power supply input 42 and in parallel with the resonant load output 44. The capacitor 48 is connected in series with the inductor 46 to provide a tunable LC circuit. The capacitor 48 has a capacitance selected, in conjunction with the inductance of the inductor 46 to produce a resonance higher than the minimum operating frequency of the power supply 12 when the inductive load 14 is disconnected at the load outputs 44. In this manner, as previously described, the power supply can continue to operate regardless of whether load 14 is connected to the power supply 12 and matching section 40. Accordingly, the power supply 12 is then operable with a load of infinite inductance. In other words, the power supply need not shut down if the circuit resonance goes to zero at the load. Additionally, the capacitance of capacitor 48 and the inductance of inductor 46 are selected such that the resonance produced when the inductive load 14 is connected to the power supply 12 through the matching circuit 40 is at or lower than the maximum operating frequency.

Where FIG. 2 schematically shows the matching section 40 as an external component to the power supply 12, FIG.

Figure 3:
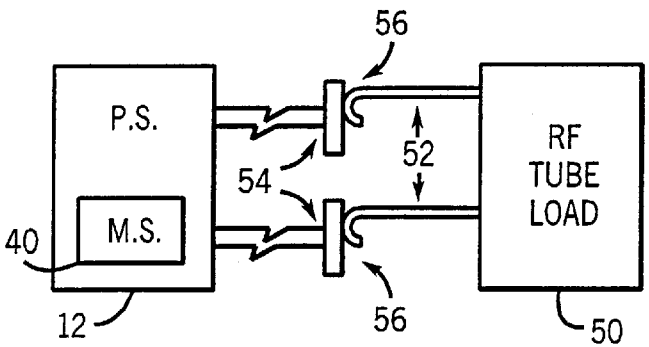
FIG. 3 is a block diagram of another embodiment of the present invention and depicting an operating environment thereof.

3 schematically shows the matching circuit 40 as an internal component to the power supply 12 such that a customer need not be concerned with any additional components and receives a more compact unit. Also depicted in FIG. 3 is a specific implementation of the present invention wherein the power supply 12 is connected to supply power to an inductive load 50 which may include an RF tube induction heater having inputs 52 connected to a pair of outputs 54 of the power supply 12 through a pair of friction connectors 56. Such friction connectors 56 are used where load 50 moves periodically with respect to the power supply 12. During normal operation, such friction connectors 56 can disconnect or arc periodically and intermittently which disturbs the voltage and current enough that a frequency controlled power supply, without the matching section of the present invention, would shut down. Accordingly, having such a matching section not only allows intermittent disconnection of the load 14, 50, it also allows the loads to be intentionally disconnected or switched while keeping the power supply running.

Similar to placing the matching section 40 either inside the power supply 12 as shown in FIG. 3, or external to the power supply as shown in FIG. 2, the matching section may also be associated with the load 14, 50. In this alternate embodiment, a tapped inductor would equivalently be located in the load.

Accordingly, the invention also includes a method of providing power from a solid-state inverter to a load that is susceptible to disconnection from the solid-state inverter without shutting down the solid-state inverter during disconnection. The method includes first determining a minimum and maximum operating frequency of the solid-state inverter, then determining an inductance of a load connectable to the solid-state inverter and a resulting resonance frequency. The method includes selecting an LC matching section connectable between the solid-state inverter and the load that permits the solid-state inverter to run at or under its maximum operating frequency when the load is connected to the solid-state inverter. The LC matching section is also selected to cause the solid-state inverter to run at or above its minimum operating frequency when the load is at least partially disconnected from the solid-state inverter.

The present invention has been described in terms of the preferred embodiment, and it is recognized that equivalents, alternatives, and modifications, aside from those expressly stated, are possible and within the scope of the appending claims.

What is claimed is:

1. A resonant load matching circuit comprising:

a circuit input connectable to, a variable frequency inverting power supply to receive power operable between a maximum frequency and a minimum frequency;

a circuit output connectable to an inductive load; and a load matching section connected between the circuit input and the circuit output to provide a resonant frequency that allows the power supply to operate at or below the maximum frequency when the load is connected to the circuit output and at or above the minimum frequency when the load is disconnected from the circuit output.

2. The circuit of claim 1 wherein the load matching section includes an inductor connected in series with the power supply input and in parallel with the circuit output.

3. The circuit of claim 2 wherein the inductor has an inductance approximately twice that of the load.

4. The circuit of claim 2 wherein the load matching section further includes a capacitor wherein an LC value of the inductor and the capacitor has a resonance at least equal to the minimum frequency of the power supply.

5. The circuit of claim 2 wherein the inductor is an adjustable tapped inductor to match the power supply to the load.

6. The circuit of claim 1 incorporated into a power supply and connected to an induction heater as the load.

7. The circuit of claim 6 wherein the power supply is operable with a load of infinite inductance.

8. The circuit of claim 6 wherein the load is intermittently connected to the power supply through a friction connector.

9. The circuit of claim 1 further including a power supply having an inverter, a phase detector, and a frequency control to adjust the operating frequency of the power supply.

10. In an induction heating apparatus comprising a solid state induction power supply having an inverter, a phase detector, and having minimum and maximum operating frequencies, the power supply connected to an inductive load, the improvement comprising a load matching section that maintains the power supply within the minimum and maximum operating frequencies while the power supply is connected to the load and while the power supply is disconnected from the load.

11. The induction heating apparatus of claim 10 wherein the load matching section includes a current path having therein an LC arrangement having a frequency resonance at least matching the minimum operating frequency.

12. The induction heating apparatus of claim 11 further comprising an inductor having inductance at least twice that of the inductive load.

13. The induction heating apparatus of claim 12 wherein the inductor is a tappable inductor with variable inductance to tune the power supply to the inductive load.

14. The induction heating apparatus of claim 12 wherein the inductive load is one of an intermittently disconnected load and a switchable load.

15. The induction heating apparatus of claim 10 wherein the load matching section includes an inductor connected both in series with the power supply and in parallel with the inductive load.

16. The induction heating apparatus of claim 15 further comprising a capacitor having capacitance selected, in conjunction with an inductance of the inductor, to produce a resonance higher than the minimum operating frequency of the power supply when the inductive load is disconnected.

17. The induction heating apparatus of claim 16 wherein the capacitance and inductance are selected such that the resonance produced when the inductive load is connected to the power supply is at or lower than the maximum operating frequency.

18. The induction heating apparatus of claim 10 wherein the inductive load is an RF tube induction heater connected to the power supply with a pair of friction connectors.

19. A method of providing power from a solid-state inverter to a load that is susceptible to disconnection from the solid-state inverter without shutting down the solid-state inverter during disconnection, comprising the steps of:

determining a minimum and maximum operating frequency of the solid-state inverter;

determining an inductance of a load connectable to the solid state inverter and a resulting operating resonance; and selecting an LC matching section connectable between the solid state inverter and the load that permits the solid state inverter to run at or under its maximum operating frequency when the load is connected to the solid state inverter and to run at or above its minimum operating frequency when the load is at least partially disconnected from the solid state inverter.

20. The method of claim 19 wherein the solid-state inverter is operable when connected to the LC matching section with a load inductance of infinity.

21. The method of claim 19 wherein an inductance of the LC matching section is selected approximately twice as large as a load inductance.

22. A load interruptible variable frequency power supply comprising:

an inverter and phase detector to supply power to a resonant load at a resonant frequency, the inverter having a minimum and a maximum operating frequency;

a feedback circuit connected to the phase detector to adjust a phase relationship between a voltage phase and a current phase based on the resonant frequency; and a matching section connected between the inverter and the resonant load, the matching section having an effect on the resonant frequency such that when the inverter is connected to the matching section and the load, the resonant frequency is operable at or below the maximum operating frequency, and such that when the inverter is connected to the matching section and disconnected from the load, the resonant frequency is operable at or above the minimum operating frequency.

23. The power supply of claim 22 wherein the matching section includes an inductor having an inductance at least twice that of the load and a capacitor sized to provide resonance at least equal to the minimum operating frequency of the inverter.

24. The power supply of claim 23 wherein the inductor is a tapped inductor to allow matching to the load at a customer site.

25. The power supply of claim 22 wherein the power supply maintains continuous operation with and without the load connected to the power supply.

* * * * *